US006250504B1

(12) United States Patent
Maffei

(10) Patent No.: US 6,250,504 B1
(45) Date of Patent: Jun. 26, 2001

(54) STOPPER-CUM-METERING DEVICE FOR THE SCREW CLOSURE OF BOTTLES FOR LIQUIDS, WITH SYRINGE DEVICE FOR DRAWING UP METERED AMOUNTS

(75) Inventor: Camilla Maffei, Pistoia (IT)

(73) Assignee: Project S.A.A. di Massimo Memchelli & C (IT)

( * ) Notice: Subject to any disclaimer, the term of this patent is extended or adjusted under 35 U.S.C. 154(b) by 0 days.

(21) Appl. No.: 09/423,055

(22) PCT Filed: Apr. 28, 1998

(86) PCT No.: PCT/IT98/00107

§ 371 Date: Oct. 29, 1999

§ 102(e) Date: Oct. 29, 1999

(87) PCT Pub. No.: WO98/50156

PCT Pub. Date: Nov. 12, 1998

(30) Foreign Application Priority Data

May 2, 1997 (IT) ..... FI97A0103

(51) Int. Cl.[7] ..... B01L 3/02
(52) U.S. Cl. ..... 222/49; 222/41; 141/381
(58) Field of Search ..... 141/22–24, 379–387; 222/41, 43, 44, 47–50

(56) References Cited

U.S. PATENT DOCUMENTS

| | | | | |
|---|---|---|---|---|
| 1,422,778 | * | 7/1922 | Petcher | 141/24 |
| 1,453,445 | * | 5/1923 | Covell | 222/49 |
| 2,129,144 | * | 9/1938 | Lancaster | 141/23 |
| 3,094,245 | * | 6/1963 | Mizuno | 222/43 |
| 5,746,349 | * | 5/1998 | Putterman et al. | 222/49 |
| 5,836,359 | * | 11/1998 | Seidler | 141/23 |

FOREIGN PATENT DOCUMENTS

| | | |
|---|---|---|
| 882 755 | 7/1953 | (DE) . |
| 1 154 232 | 9/1963 | (DE) . |
| 79 29 839 | 2/1980 | (DE) . |
| 85 29 592 | 7/1986 | (DE) . |
| 0 723 921 A2 | 7/1996 | (EP) . |
| 814161 | 5/1959 | (GB) . |

* cited by examiner

*Primary Examiner*—J. Casimer Jacyna
(74) *Attorney, Agent, or Firm*—McGlew and Tuttle, P.C.

(57) ABSTRACT

A stopper is provided which is intended to replace the lid fitted at the production stage, for the screw closure of bottles for liquids, with a device for drawing up metered amounts of the product. A stopper includes a capsule (9) with internal thread for screwing onto the threaded neck (1A) of the bottle. The capsule (9) forms coaxially and in one piece a cylinder (12) of a syringe metering device (10). The syringe metering device(10) has a control rod (16) which is graduated to allow measurement of the suction stroke of the plunger and hence to allow measurement of the amount of liquid drawn up.

7 Claims, 2 Drawing Sheets

STOPPER-CUM-METERING DEVICE FOR THE SCREW CLOSURE OF BOTTLES FOR LIQUIDS, WITH SYRINGE DEVICE FOR DRAWING UP METERED AMOUNTS

FIELD AND BACKGROUND OF THE INVENTION

The invention relates to a stopper-cum-metering device for the crew closure of bottles for liquids with a device for drawing up metered mounts of the product; this stopper is simple and convenient to use.

SUMMARY AND OBJECTS OF THE INVENTION

Said stopper-cum-metering device comprises a capsule with an internal thread for screwing onto the threaded neck of the bottle, which capsule forms coaxially and in one piece the cylinder of a syringe device hose plunger is worked by a rod which is graduated to allow measurement of the suction stroke of the plunger and hence of the amount of liquid drawn up.

A component internal to the capsule and positioned around the cylinder may be provided to form an annular seal that can be clamped onto the rim of the neck of the bottle by the screwing on of the capsule. Said internal component may form not only the annular seal but also, around the cylinder, an annular lip directed toward the center of the bottle; this lip is for wiping the outer surface of the cylinder during withdrawal of the capsule. Said internal component may be so shaped that it engages in the neck of the bottle when the capsule is first screwed onto the neck of the bottle. This internal component may in particular include a section capable of being forced into the neck of the bottle, being of dimensions such as to give limited interference with the internal dimension of the neck, by exploiting the elastic properties of the internal component.

The internal component that forms a lip for wiping the outer surface of the cylinder of the syringe device may include at least one hole in said lip, so that differential pressures do not develop between the outside and inside of the bottle. The shaping of the capsule and of the wiper lip may be such that the lip essentially fits an intermediate structure between the capsule and the cylinder of the syringe device; when the capsule is in its screwed position on the neck of the bottle there is contact between this structure and the wiper lip, of essentially tapering form, and the above-mentioned hole is consequently closed, to ensure that liquid is not lost through said hole or holes between the intermediate structure (and hence the capsule) and said internal component that forms the seal and the wiper lip. This is especially useful when the bottle is horizontal.

BRIEF DESCRIPTION OF THE DRAWINGS

A better understanding of the innovation will be gained by following the description with reference to the accompanying drawing, which shows a non-limiting example of an embodiment thereof. In particular, in the drawing.

DESCRIPTION OF THE PREFERRED EMBODIMENT

Figure 1:
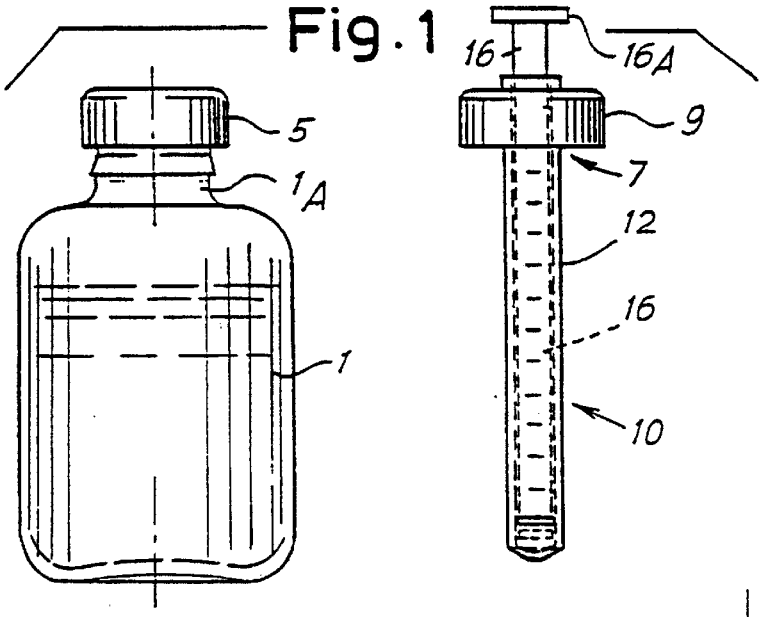
FIG. 1 shows a sketch of the complete system, packageable in a protective box or the like, with the bottle sealed for long-term storage and accompanied by a separate stopper-cum-metering device for drawing the product up, after the bottle has been opened.
Figure 2:
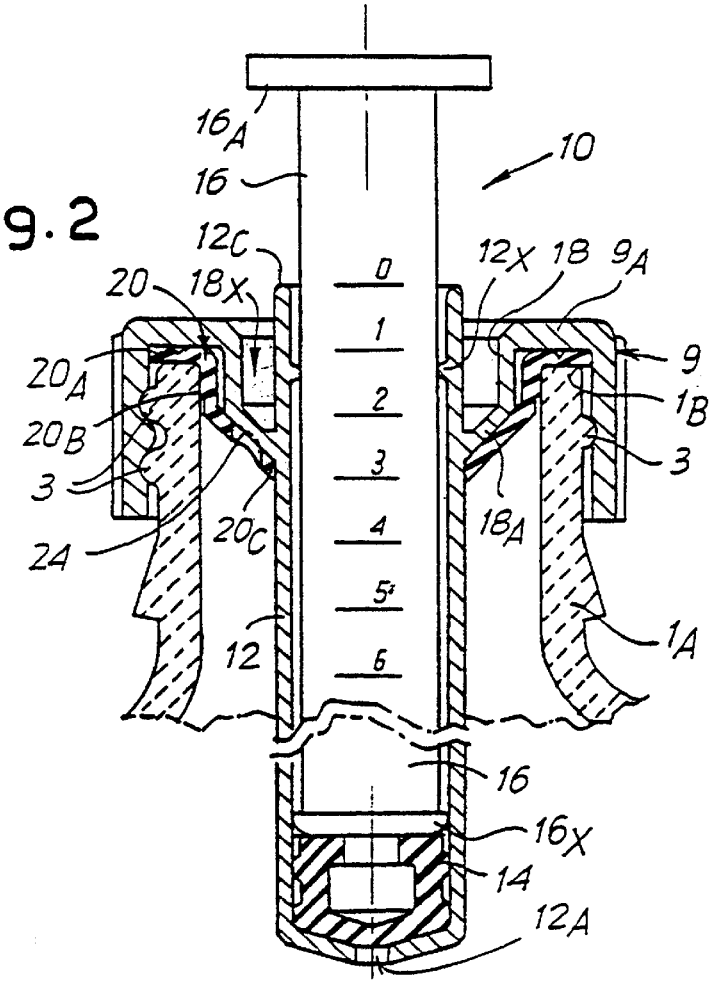
FIG. 2 shows a partial cross section of a stopper-cum-metering device which is to replace the lid of the original packing and allow the contents of the bottle to be drawn up by the syringe device.
Figure 3:
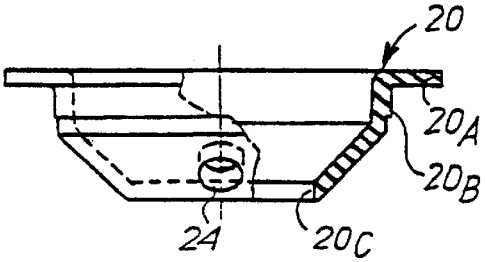
FIGS. 3 and 4 show separately two components of the stopper-cum-metering device.

As shown in the drawing, 1 denotes the bottle whose neck 1A has an external thread 3 (see FIG. 2 in particular) that serves for fitting the lid 5 used for the closure immediately after filling the bottle and throughout the period of long-term storage, that is to say warehousing and distribution. 7 is the general reference for a stopper-cum-metering device to be used in place of the lid 5, once the bottle has been broken open by removing this lid 5; the stopper-cum-metering device 7 comprises a syringe device for drawing up metered amounts of the contents of the bottle, for use of these contents.

In the embodiment shown in FIGS. 2–4, 9 denotes a capsule capable of being screwed onto the thread 3 in place of the lid 5 when the contents of the bottle are to be used in metered doses. The capsule 9 is substantially equivalent to the lid 5, but is made in one piece with a cylinder 12; this cylinder forms part of a syringe metering device 10, together with a plunger 14 that forms a hermetic seal as it slides against the inside surface of the cylinder 12 and is mounted on the inward end of a rod 16, one end 16A of which, passing out through the capsule 9, is suitable for the operations of moving the rod 16 and hence the plunger 14. The plunger 14 may be dispensed with and replaced by an appropriate annular terminal shaping of the rod to give a sliding seal with the inside surface of the cylinder 12. In either case the rod 16 has a collar 16X. The cylinder 12 contains a hole 12A at its inward end to allow communication between the inside of the bottle and the cylinder. When the capsule 9 is screwed onto the neck 1A of the bottle, the hole 12A will be within a short distance of the bottom of the bottle 1 when arranged vertically. The cylinder 12—formed in one piece with the capsule 9—is combined with a structure 18 joining it to the top 9A of the capsule 9; this structure 18 comprises, specifically, a tapering, and in particular frustoconical, section 18A where it connects with the cylinder 12, and a cylindrical section as it joins the top 9A of the capsule 9. The section 18, 18A defines a cavity 18X surrounding the cylinder 12 in the region of an annular ridge 12X on the inside of the cylinder 12. This cavity 18X makes the molding of the ridge 12X possible.

20 denotes an internal component of sufficiently elastic material for the purposes indicated later: it forms an annular seal 20A that fits between the top 9A of the capsule 9 and the rim 1B of the neck 1A of the bottle; said annular seal is functional when the capsule 9 is screwed onto the screwthread 3. The internal component 20 includes an essentially cylindrical section 20B whose external diameter is slightly greater than the internal diameter of the neck 1A of the bottle and may correspond to the cylindrical section of the structure 18. The internal component 20A forms a terminal annular lip 20C of essentially frustoconical form directed toward the center of the bottle, when the capsule 9 is fitted over the neck 1A; the terminal edge of said lip encircles and tends to conform closely to the outer surface of the cylinder 12 so as to form a wiper for wiping, that is to say cleaning said outer surface of the cylinder 12, for the purposes indicated later. The internal component 20 may be retained by being slightly forced into the capsule 9 or by exploiting the friction between the outer edge of the annular seal 20A and the corresponding inside surface of the capsule 9, or by other such means.

The stopper-cum-metering device 7 with the capsule 9, the syringe device 10 and the internal component 20 constitute a single assembly that can be manipulated for the purposes of packaging it together with the closed bottle 1 having its own lid 5, in a cardboard box or other pack for sale.

When the contents of the bottle are to be used—a process that does not normally extend in time beyond the first administration of the contents—the lid 5 is taken off and the stopper-cum-metering device 7 is fitted onto it by screwing the screw capsule 9 onto the screwthread 3; in this operation the internal component 20 is easily forced—simply by virtue of the screw coupling—into the neck 1A of the bottle, where this internal component 20 will continue to be held sufficiently firmly for the use of the stopper-cum-metering device 7.

To draw up a metered amount of the contents of the bottle, the rod 16, 16A is operated, causing the plunger 14 to move and draw into the cylinder 12 through the hole 12A the desired amount of liquid to be administered, before the capsule 9 is unscrewed or with only very slight slackening of said capsule; the amount can easily be checked by providing the rod 16 with graduations, the index for which may be the upper edge 12C of the cylinder, which is easily visible from the outside. The annular ridge 12X acts on the collar 16X to prevent the rod 16 from coming out of the cylinder 12. The capsule 9 is then taken off in order to use the metered liquid which is expelled by pushing the rod 16 of the plunger in the reverse direction in order to expel the product drawn up by the syringe system consisting of the cylinder 12 and plunger 14 with rod 16. It should be observed that any liquid that may cling to the outside surface of the cylinder 12 will be wiped off by said lip 20C of the internal component 20, which remains in the neck of the bottle, and the cylinder 12 moves relative to this lip 20C during the extraction of the assembled capsule 9 and syringe system 10 (cylinder 12 and plunger 14 with rod 16); the withdrawn stopper-cum-metering device assembly 7 does not therefore present the risk of bringing out a significant quantity of liquid that could drip or that would then have to be returned to the bottle.

The lip 20C contains at least one hole 24: this allows communication between the outside and inside of the bottle so as to avoid a pressure difference building up during the operations of aspiration and of withdrawal of the cylinder 12 through the lip 20C, and the reverse operations, especially when inserting the assembly 9, 10 into the bottle 1. This hole 24 is effectively closed by the contact of the lip 20C with the tapering—essentially frustoconical—section 18A that corresponds to the profile of the lip 20C, when the assembly is closed; the liquid contained in the bottle does not therefore penetrate between the structure 18, 18A and the internal component 20 when the capsule 9 is in the closed position, even if the bottle is held horizontally or tilted with the neck in a downward direction.

Figure 5:
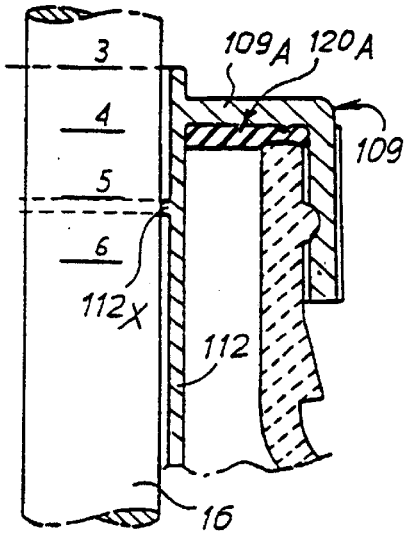
FIGS. 5 and 6 show locally two possible variants and simplifications compared with the version of FIG. 2.
Figure 4:
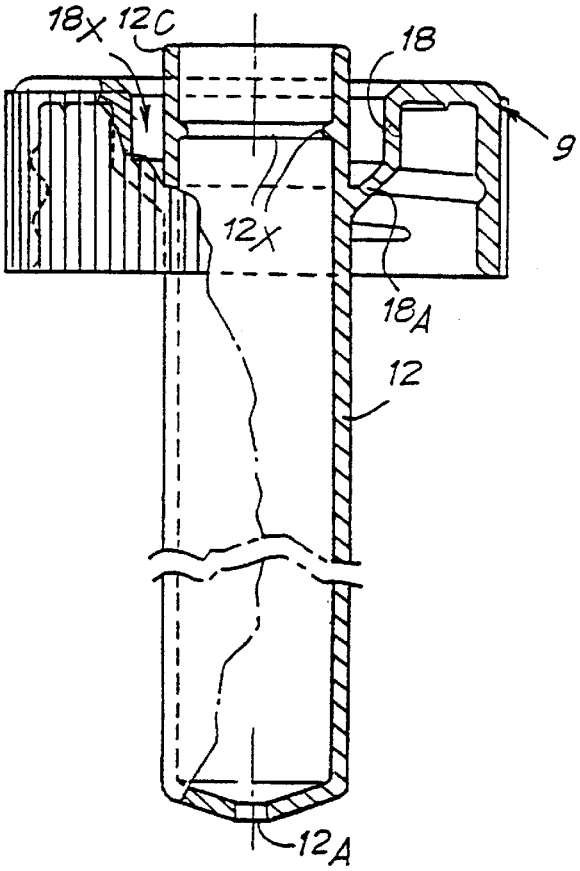

FIG. 5 shows a modified version in which the internal component 20 is limited to a generally diskoidal portion 120A that constitutes the seal and can be held in place either by friction on the surface of the cylinder 112, equivalent to cylinder 12 but directly joined to the top 109A of the capsule 109, or pinched on the inside surface of the side wall of the capsule 109. The annular ridge 112X (equivalent to ridge 12x) is suitably out of alignment with the top 109A.

Figure 6:
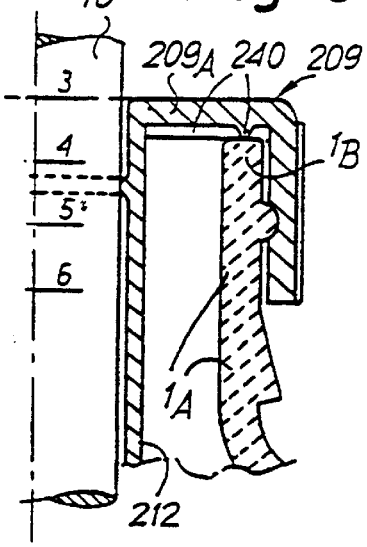

In the further variant, FIG. 6, there is no internal component such as 20 or such as 120A, but the capsule 209 (equivalent to 9 or 109) will be made of a material of sufficient stiffness to form the capsule 209 and the wall of the cylinder 212 equivalent to cylinder 12, though with a narrow internal edge 240 on the internal surface of the top 209A of the capsule 209; when the capsule 209 is screwed on, said edge 240 acts on the rim 1B of the bottle to ensure adequate leaktightness and closure of the bottle, during the relatively brief period in which the bottle is closed by the capsule 209 during the withdrawals of the bottle's contents.

It should be understood that the drawing shows only an example purely as a practical demonstration of the innovation, since the latter may be varied in its shapes and arrangements without thereby departing from the scope of the concept on which the innovation is based. The presence of any reference numerals in the accompanying claims is for the purpose of facilitating the reading of the claims with reference to the description and drawing, and does not limit the scope of protection represented by the claims.

What is claimed is:

1. A stopper, intended to replace the lid fitted at the production stage, for the screw closure of bottles for liquids, with a device for drawing up metered amounts of said product, said stopper comprising a capsule (9) provided with an internal thread and forming coaxially and in one piece a cylinder (12) of a syringe metering device (10) with a graduated control rod (16) to allow measurement of the suction stroke of a plunger (14) and hence of the amount of liquid drawn up in the metering device (10), and in which there is formed, on the inside of the cylinder (12), a ridge (12X), and level with this, around the cylinder, is a cavity (18) to enable demolding of the cylinder (12); said rod (16) having a collar (16X) cooperating with said ridge (12X).

2. Stopper as claimed in claim 1, in which a component (20) internal to the capsule (9) and positioned around the cylinder forms an annular seal (20A) that can be clamped onto the rim (1B) of the neck (1A) of the bottle by the screwing on of the capsule (9).

3. Stopper as claimed in claim 2, in which said internal component (20) forms not only the annular seal (20A) but also, around the cylinder (12), an annular lip (20C) directed toward the center of the bottle for wiping the outer surface of the cylinder (12) during withdrawal of the capsule (9); said internal component (20) being so shaped as to engage with the neck of the bottle when the stopper is first screwed onto the neck of the bottle.

4. Stopper as claimed in claim 3, in which said internal component (20) includes a section (20B) capable of being forced into the neck (1A) of the bottle.

5. Stopper as claimed in claim 3, in which said internal component (20) includes at least one hole (24) in said lip (20C) so that differential pressures do not occur between the outside and inside of the bottle.

6. Stopper as claimed in claim 5, in which said lip (20C) essentially fits an intermediate structure (18A) between the capsule (9) and the cylinder (12) of the syringe device, so that the or each hole (24) is essentially closed when the stopper-cum-metering device (7) is in the fitted position.

7. Stopper as claimed in claim 1, in which the rod (16) comprises a plunger (14) which may either be attached or formed in one piece with the rod itself.

* * * * *